US011503903B2

(12) United States Patent
Haddy

(10) Patent No.: US 11,503,903 B2
(45) Date of Patent: Nov. 22, 2022

(54) PORTABLE FOLDING TABLE

(71) Applicant: Gary Haddy, San Clemente, CA (US)

(72) Inventor: Gary Haddy, San Clemente, CA (US)

( * ) Notice: Subject to any disclaimer, the term of this patent is extended or adjusted under 35 U.S.C. 154(b) by 0 days.

(21) Appl. No.: 17/105,933

(22) Filed: Nov. 27, 2020

(65) Prior Publication Data

US 2021/0153643 A1 May 27, 2021

Related U.S. Application Data

(60) Provisional application No. 62/941,111, filed on Nov. 27, 2019.

(51) Int. Cl.

| | |
|---|---|
| ***A47B 3/08*** | (2006.01) |
| ***A47B 3/083*** | (2006.01) |
| ***A47B 5/04*** | (2006.01) |
| ***A47B 13/16*** | (2006.01) |

(52) U.S. Cl.

CPC ..... *A47B 3/083* (2013.01); *A47B 5/04* (2013.01); *A47B 13/16* (2013.01); *A47B 2200/0051* (2013.01)

(58) Field of Classification Search

CPC ..... A47B 3/083; A47B 2003/0835; A47B 23/041

USPC ..... 108/43

See application file for complete search history.

(56) References Cited

U.S. PATENT DOCUMENTS

| | | | | | |
|---|---|---|---|---|---|
| 56,769 | A * | 7/1866 | Loth | A47B 3/083 | 108/173 |
| 696,044 | A * | 3/1902 | Hoffmann | A47B 23/002 | 108/43 |
| 1,336,954 | A * | 4/1920 | Gillies | A47B 3/04 | 108/43 |
| 1,702,952 | A * | 2/1929 | Schmitt | A47B 3/083 | 108/171 |
| 1,851,600 | A * | 3/1932 | Stanley | A47B 23/041 | 108/43 |
| 2,699,977 | A * | 1/1955 | Breslow | A47B 3/083 | 108/35 |
| 2,743,979 | A * | 5/1956 | Shore | A47B 3/083 | 108/35 |
| 2,862,777 | A * | 12/1958 | Paige | A47B 3/083 | 108/34 |
| 2,903,313 | A * | 9/1959 | Block | A47B 3/083 | 108/35 |
| 2,963,331 | A * | 12/1960 | Bereman | A47B 3/083 | 108/35 |

(Continued)

*Primary Examiner* — Jose V Chen

(74) *Attorney, Agent, or Firm* — Innovent Law, P.C.; Karima Gulick

(57) ABSTRACT

A portable folding table system with folding and slide locking mechanism that secures the folding table in both storage and in-use position and can be wearable on a person. The table comprises at least two panels, with hinges between the section such that they may be folded along the intersections of the panels until the folding table is the size of one panel. Additionally, the table panels incorporate sliding locking mechanisms operable to lock the table in an unfolded position. Other features include: a cup holder operable to adjust for various sizes of beverage containers, strap attachment points operable to allow the table to be strapped to a person and kept level, and telescoping legs operable to be attached to the table and used to support it.

16 Claims, 9 Drawing Sheets

(56) References Cited

U.S. PATENT DOCUMENTS 3,090,330 A * 5/1963 Best ..... A45F 5/00 108/43
3,541,976 A * 11/1970 Rozas ..... A47B 23/002 108/43
3,791,314 A * 2/1974 Berretta ..... A47B 23/002 108/43
4,852,498 A * 8/1989 Judd ..... A47B 23/043 108/43
8,091,486 B1 * 1/2012 Broaddrick ..... A47G 23/0633 108/43
8,157,137 B1 * 4/2012 Laird ..... A47G 23/06 224/258
8,176,855 B1 * 5/2012 Cannon ..... A47G 23/06 108/25
8,418,629 B2 * 4/2013 Yu ..... F16M 13/04 108/43
8,534,205 B1 * 9/2013 Johnson ..... A47B 13/08 108/132
10,517,395 B2 * 12/2019 Wasserman ..... A47B 25/00
2004/0112259 A1 * 6/2004 Zeiders ..... A47B 23/041 108/43
2006/0237518 A1 * 10/2006 Hageneder ..... B42D 9/00 229/67.1
2007/0119348 A1 * 5/2007 Evans ..... B60N 3/002 108/44
2008/0042475 A1 * 2/2008 Wright ..... A47C 7/56 297/16.2
2008/0149802 A1 * 6/2008 Chiang ..... A47B 3/10 248/461
2009/0272779 A1 * 11/2009 Vu ..... A45F 5/00 224/677
2013/0061781 A1 * 3/2013 Wong ..... A47B 21/04 108/3
2014/0216306 A1 * 8/2014 Allen ..... A47B 23/002 108/43
2015/0340892 A1 * 11/2015 Schreiner ..... A47B 21/06 320/137
2018/0035800 A1 * 2/2018 Okeke ..... A47B 13/16
2020/0154877 A1 * 5/2020 Hurley ..... A47B 3/10
2020/0260863 A1 * 8/2020 Leng ..... A47B 13/08

* cited by examiner

PORTABLE FOLDING TABLE

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

CROSS REFERENCE TO RELATED APPLICATIONS

The present application claims benefit of U.S. Provisional Application No. 62/941,111 filed Nov. 27, 2019, entitled Portable folding table. The entire contents of 62/941,111 hereby incorporated by reference.

BACKGROUND OF THE INVENTION

1. Field of the Invention

This invention relates to portable folding tables. More particularly, the invention relates to a portable folding table with folding and slide locking mechanism that secure the folding table in both storage and in-use position and can be wearable on a person.

2. Description of the Related Art

In markets today, there are very limited products offered for portable folding tables and an even more limited selection for light portable folding tables that can be worn around a person and used on the go at various events.

Many different types of tables are well known and used for a variety of different purposes. For example, conventional tables may include legs that are pivotally attached to the table-top and the legs may be movable between a use position in which the legs extend outwardly from the table-top and a storage position in which the legs are folded against the table-top. Although portable, these foldable tables tend to be big banquet or card tables that cannot conveniently carried around to events or picnics.

Some restaurants offer trays or boxes that hold food for use in your car or at live events, but these solutions are not foldable and cannot be conveniently reused, stored away or worn on a person.

Currently, there are no useful alternatives that act as a portable folding table which can be conveniently used on the go and at events such as concerts, sporting events, backpacking, camping, cars and car seats, at the beach or at a picnic and which can be worn on a person or used as a lap table and foldable into a small device that can be stowed away in a small bag, backpack or other small containers that can be conveniently carried. As will be disclosed below, the present disclosure addresses these needs and covers a device and method to use a portable folding table to prevent these inconveniences and solve these issues.

SUMMARY OF THE INVENTION

In one aspect, the present invention is embodied and broadly described as a portable folding table comprising at least two panels defining an outer perimeter of the portable folding table, wherein the at least two panels are operable to move between a flat position and a folded position, a first side along a first panel, a second side opposite said first side along a second panel, a first sliding hinge lock alongside said first side and said perimeter wherein a user can slide the first sliding hinge lock to lock the at least two panels together in the flat position, and a second sliding hinge lock alongside said second side and said perimeter wherein the user can slide the second sliding hinge lock to lock the at least two panels together in the flat position. The table folds along the edges of the panels and includes a sliding hinge lock mechanism to keep the folded table locked securely during use, and securely folded when stored.

In some embodiments, the portable folding table comprises two panels whereas in other embodiments, the portable table includes four complimentary quarter panels such that the portable folding table folds along the edges of the panels, wherein when folded, the portable folding table is as small as the surface area of one panel.

The portable folding table can also include a telescoping leg or legs, attached to the portable folding table by means of an attachment point, that extend outwardly from a bottom face of the portable folding table such that when picnicking or laying somewhere, the user can extend the legs of the foldable table and the table can rest on a horizontal flat surface.

In some embodiments, the portable folding table includes one or more openings or a mechanism to attach a cup holder. In other embodiments, the cup holder also includes an adapter so that a user can adjust the size of the cup holder to fit various cup sizes. The adapter can also cover the entire opening of the cup holder such that it looks flush with the rest of the table and food or other objects do not fall through those openings.

In some embodiments a recessed indentation is present in at least one panel of the portable folding table, wherein the recessed indentation is operable to locate a container.

In one embodiment, the portable folding table also includes openings or attachments along the outer perimeter of the portable folding table adapted for trash receptacles.

The portable folding table can be worn around a person's neck or waist using one or more straps that attach to the folding table and can be worn on a person. The portable folding table waist strap allows the user to wear the portable folding table around the user's waist, thereby keeping said table close to the user's body, and avoid sliding off of user's lap, if the user is seated.

While worn, special attachments make it such that the table stay horizontally flat when worn so that food or liquid do not spill from the worn table.

The table can be made of plastic, wood, metal, or any other material that may be folded into a compact portable table. The variety of materials the table may be made from is especially useful in venues that ban glass or other materials because it can be made to comply with such a venue's rules. The straps can be made out of hemp, fabric or any other suitable material for straps worn by a person. The table can also be made out of slip resistant material such that when extended, the table does not slip.

In one embodiment, the table has four panels operable to form a tabletop when extended into a flat position, wherein each panel has an outer side and an inner side a hinge, and two panels are hinged together by the hinge along the outer sides of the panels a first panel is configured to fold onto a second panel about a first axis defined by the outer edges of the first and second panel a fourth panel is configured to fold onto a third panel about a second defined by the outer edges of the third and fourth panel, wherein the four panels are operable to fold the tabletop into a portable carrying device.

In another embodiment, at least one attachment mechanism is attached to a bottom of the table and is operable to hold at least one eating utensil.

Before explaining the various embodiments of the invention in detail, it is to be understood that the invention is not limited in its application to the details of construction and to the arrangements of the components set forth in the following description or illustrated in the drawings. Rather, the invention is capable of other embodiments and of being practiced and carried out in various ways. Also, it is to be understood that the terminology employed herein is for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

For a better understanding of the invention, its operating advantages and the specific objects attained by its uses, reference should be made to the accompanying drawings and descriptive matter in which there are illustrated preferred embodiments of the invention.

Various objects, features, aspects and advantages of the present embodiment will become more apparent from the following detailed description of embodiments of the embodiment, along with the accompanying drawings in which like numerals represent like components.

BRIEF DESCRIPTION OF THE DRAWINGS

It should be noted that the drawing figures may be in simplified form and might not be to precise scale.

The same elements or parts throughout the figures of the drawings are designated by the same reference characters, while equivalent elements bear a prime designation.

DETAILED DESCRIPTION OF THE INVENTION

The embodiment and various embodiments can now be better understood by turning to the following detailed description of the embodiments, which are presented as illustrated examples of the embodiment defined in the claims. It is expressly understood that the embodiment as defined by the claims may be broader than the illustrated embodiments described below. Many alterations and modifications may be made by those having ordinary skill in the art without departing from the spirit and scope of the embodiments.

Figure 1:
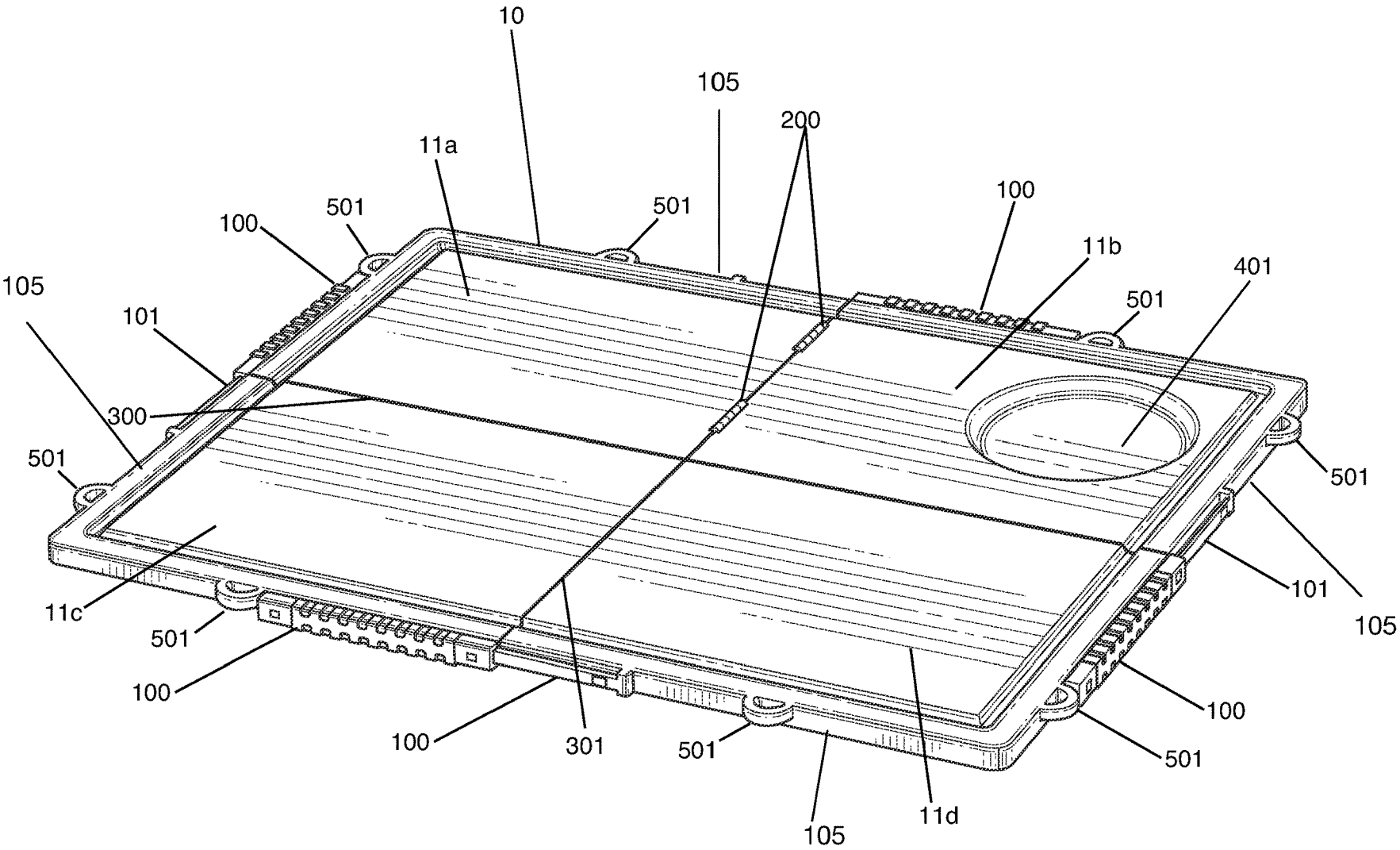
FIG. 1 is an isometric top view of one embodiment of the present invention.
Figure 2:
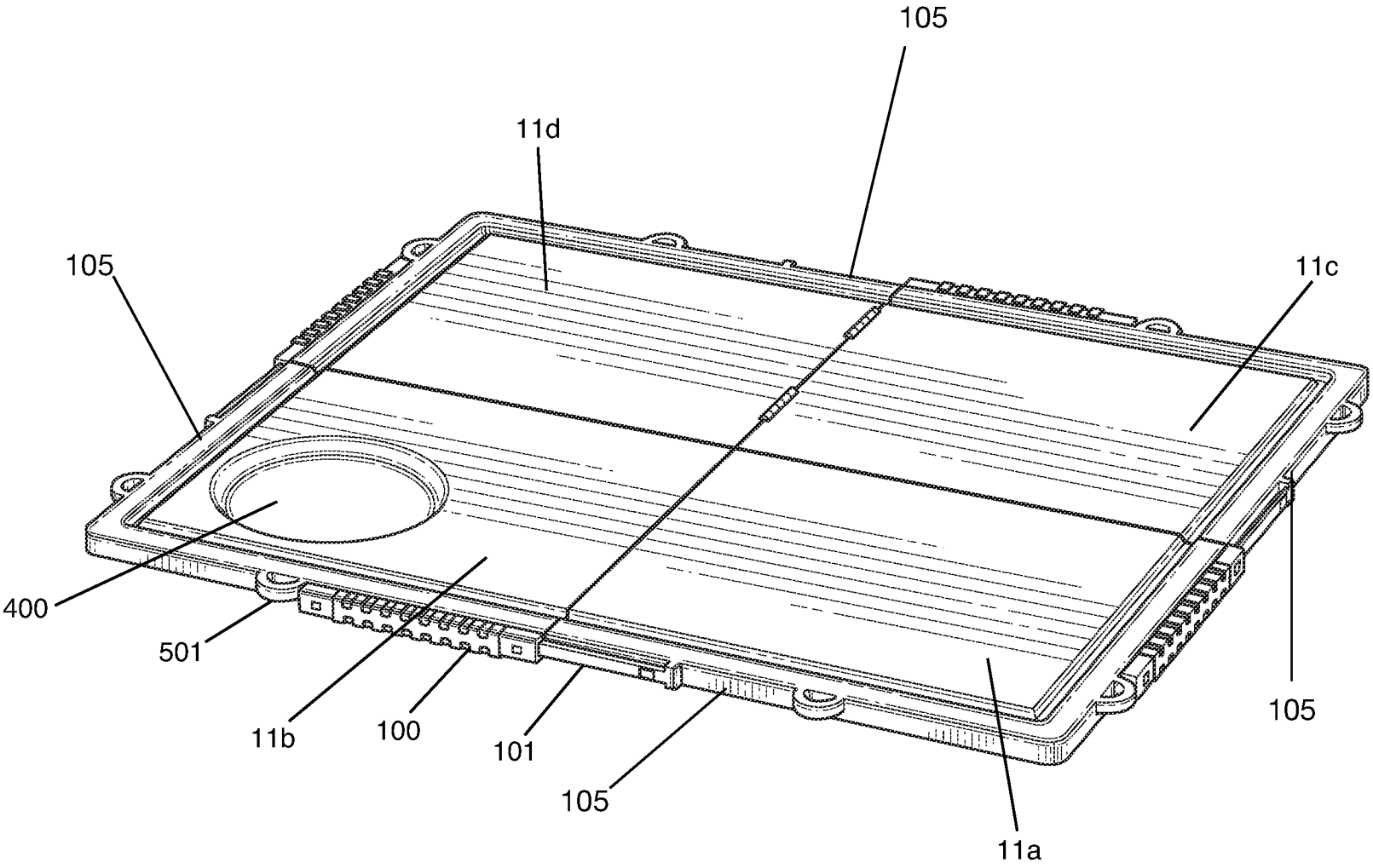
FIG. 2 is an isometric top view of one embodiment of the present invention.
Figure 3:
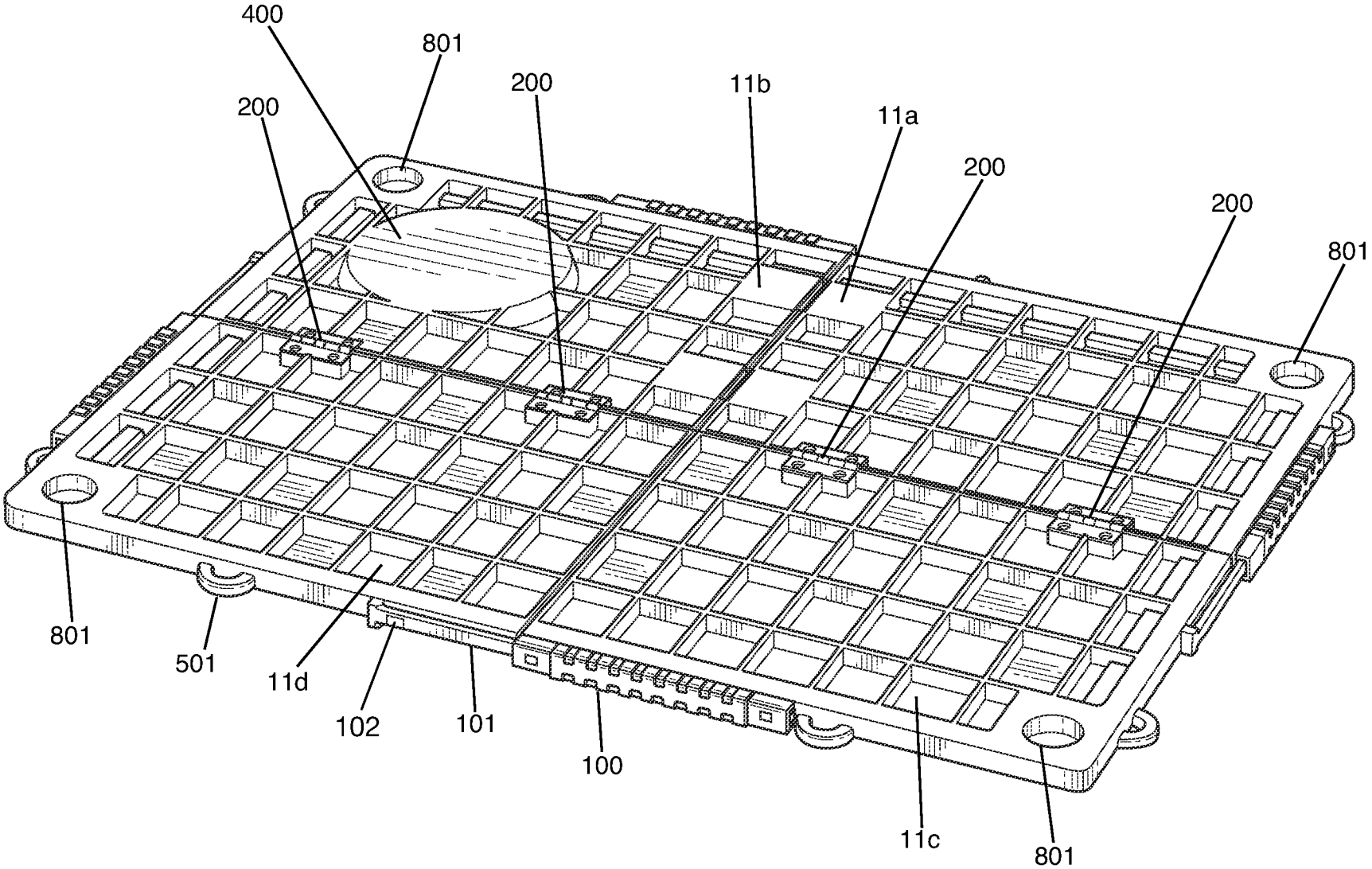
FIG. 3 is an isometric bottom view of one embodiment of the present invention.
Figure 4:
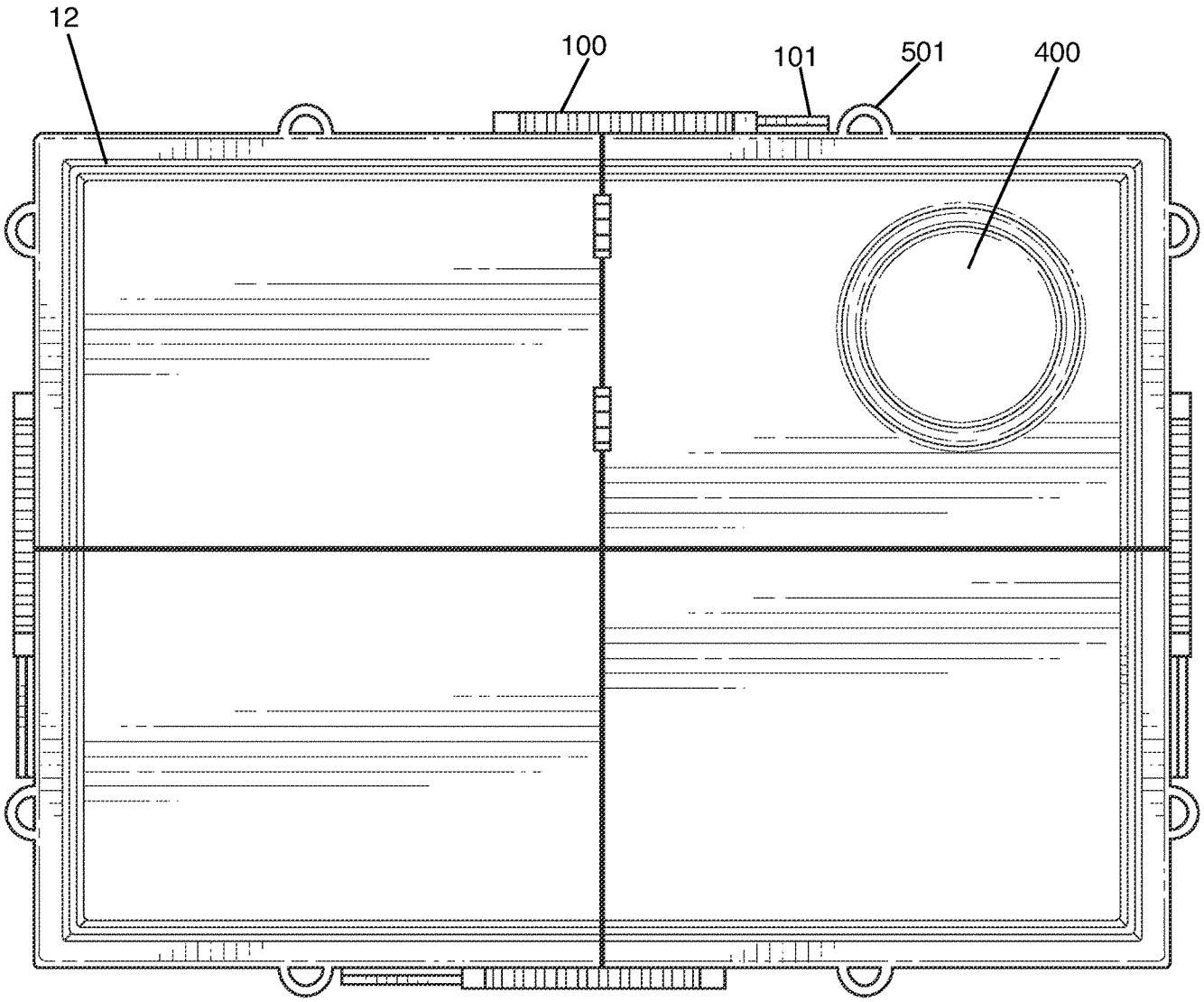
FIG. 4 is a top view of one embodiment of the present invention.

Referring now to the drawings and the characters of reference marked thereon, FIG. 1 shows a top view of one embodiment of the present invention.

The embodiment of FIGS. 1-10 show a portable folding table 10 with four panels 11*a-d*, and hinges 200 along the junction of the panels 11*a* and 11*b*, and 11*a* and 11*c*, and 11*b* and 11*d*. The four panels 11*a-d* together form a tabletop when extended into a flat position and are locked into the flat position using the sliding hinge lock 100 and sliding lock beam 101, wherein the sliding hinge lock engages the sliding lock beam such that the four panels 11*a-d* are held in the flat position.

Figure 6:
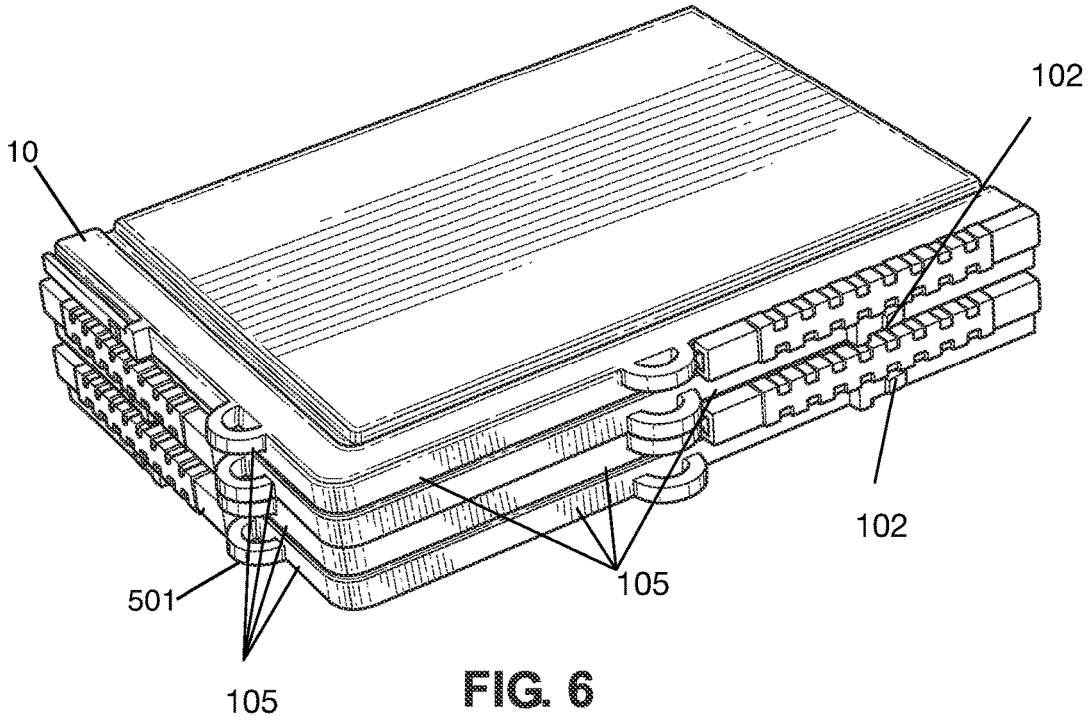
FIG. 6 is an isometric top view of one embodiment of the present invention in a folded configuration.
Figure 7:
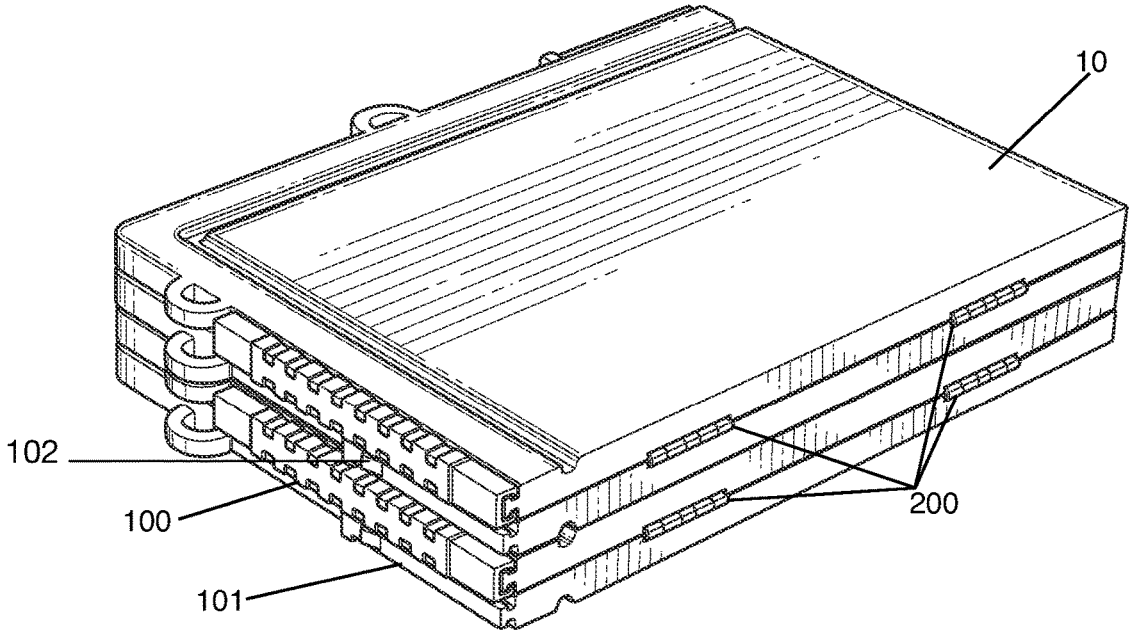
FIG. 7 is an isometric top view of one embodiment of the present invention in a folded configuration.

Additionally, panels 11*a* and 11*c* are configured to fold onto panels 11*b* and 11*d* about the first folding axis 300 and panels 11*c* and 11*d* are configured to fold onto panels 11*a* and 11*b* about the second folding axis 301, to fold the portable folding table 10 into a quarter-sized, self-contained and portable carrying device, as illustrated in FIGS. 6 and 7.

Figure 8:
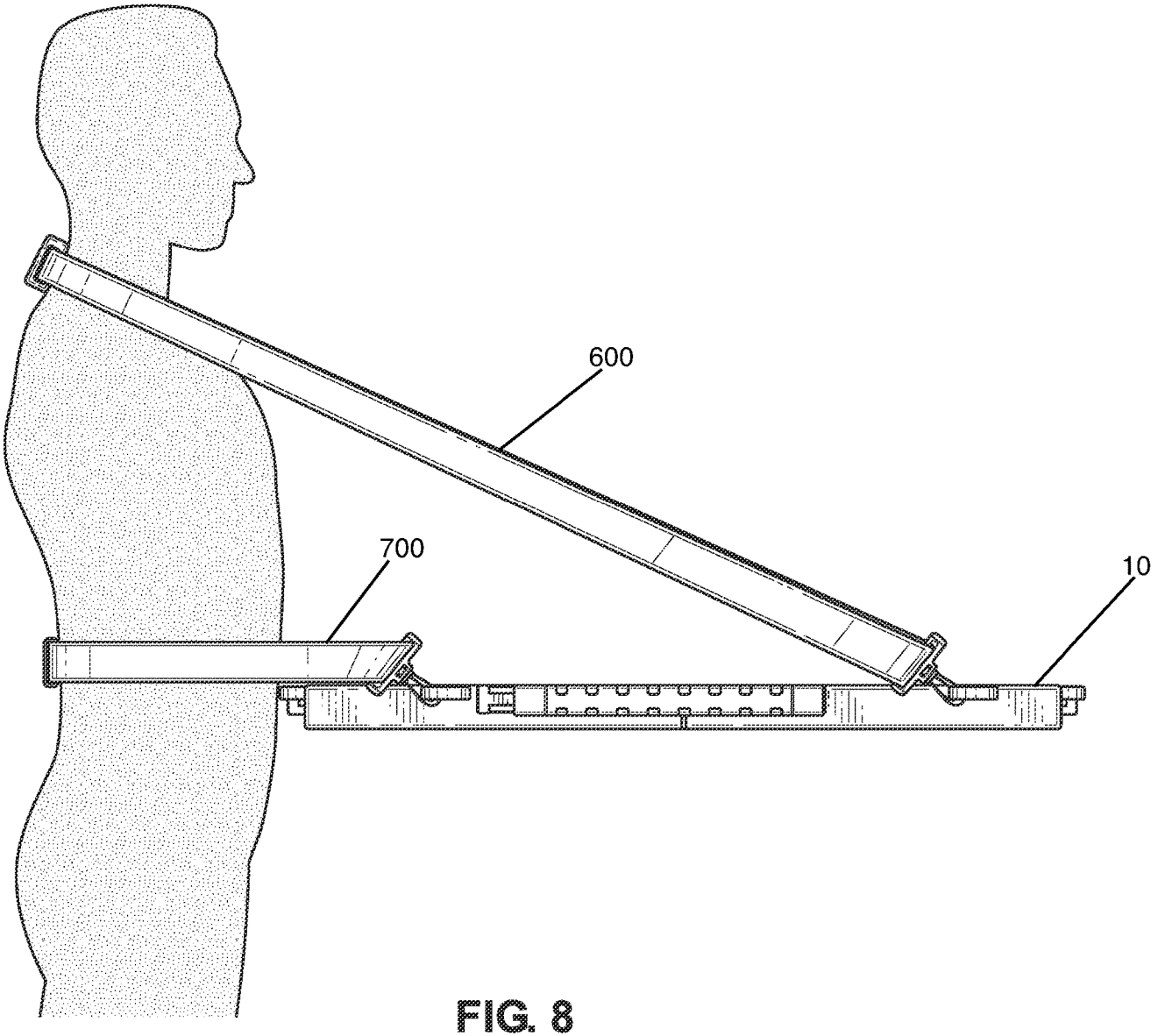
FIG. 8 is a side view of one embodiment of the present invention including a waist and neck strap such that the table can be worn around a person's neck or waist.
Figure 9:
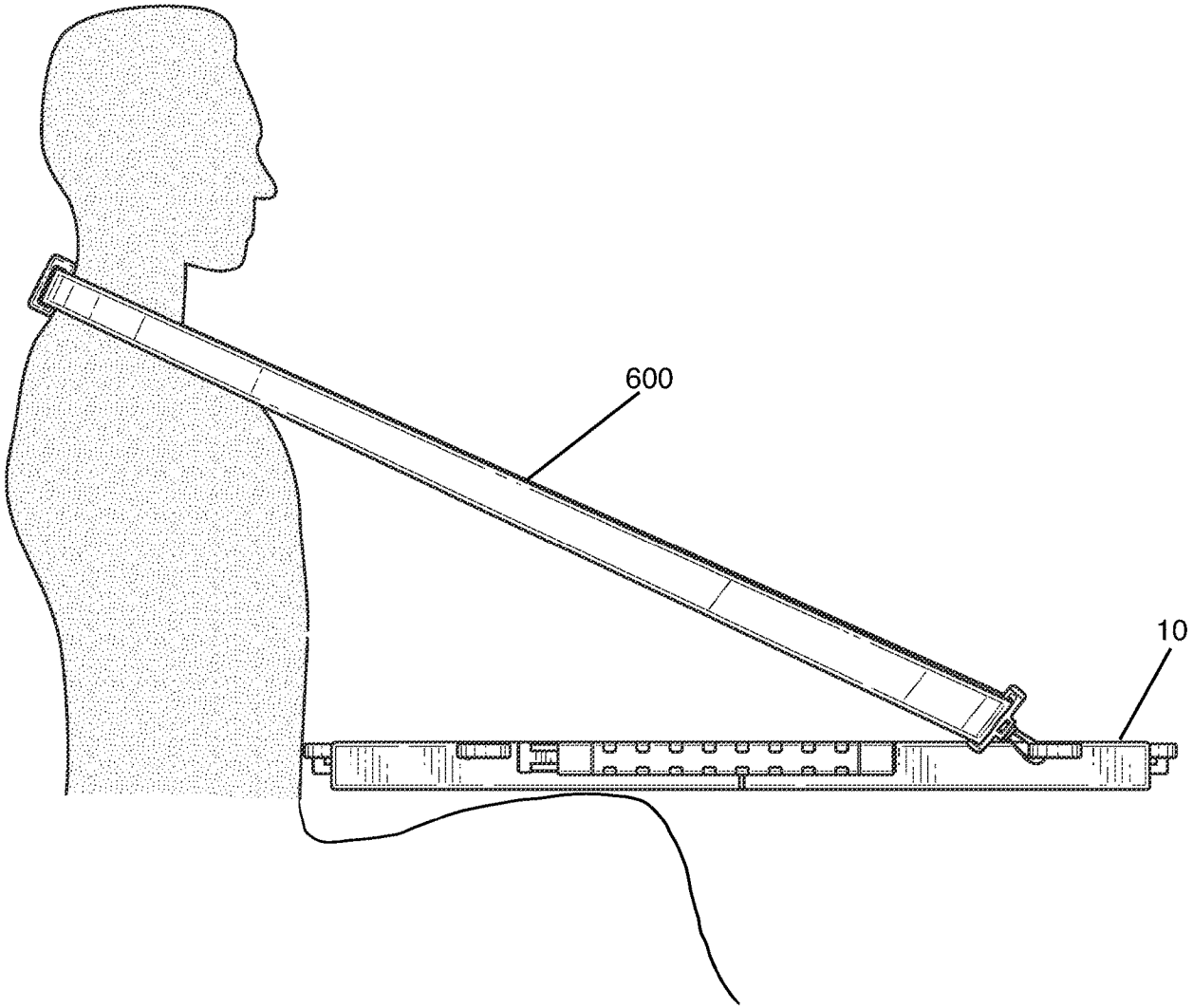
FIG. 9 is a side view of one embodiment of the present invention including a neck strap such that the table can be worn around a person's neck when a user is sitting.
Figure 10:
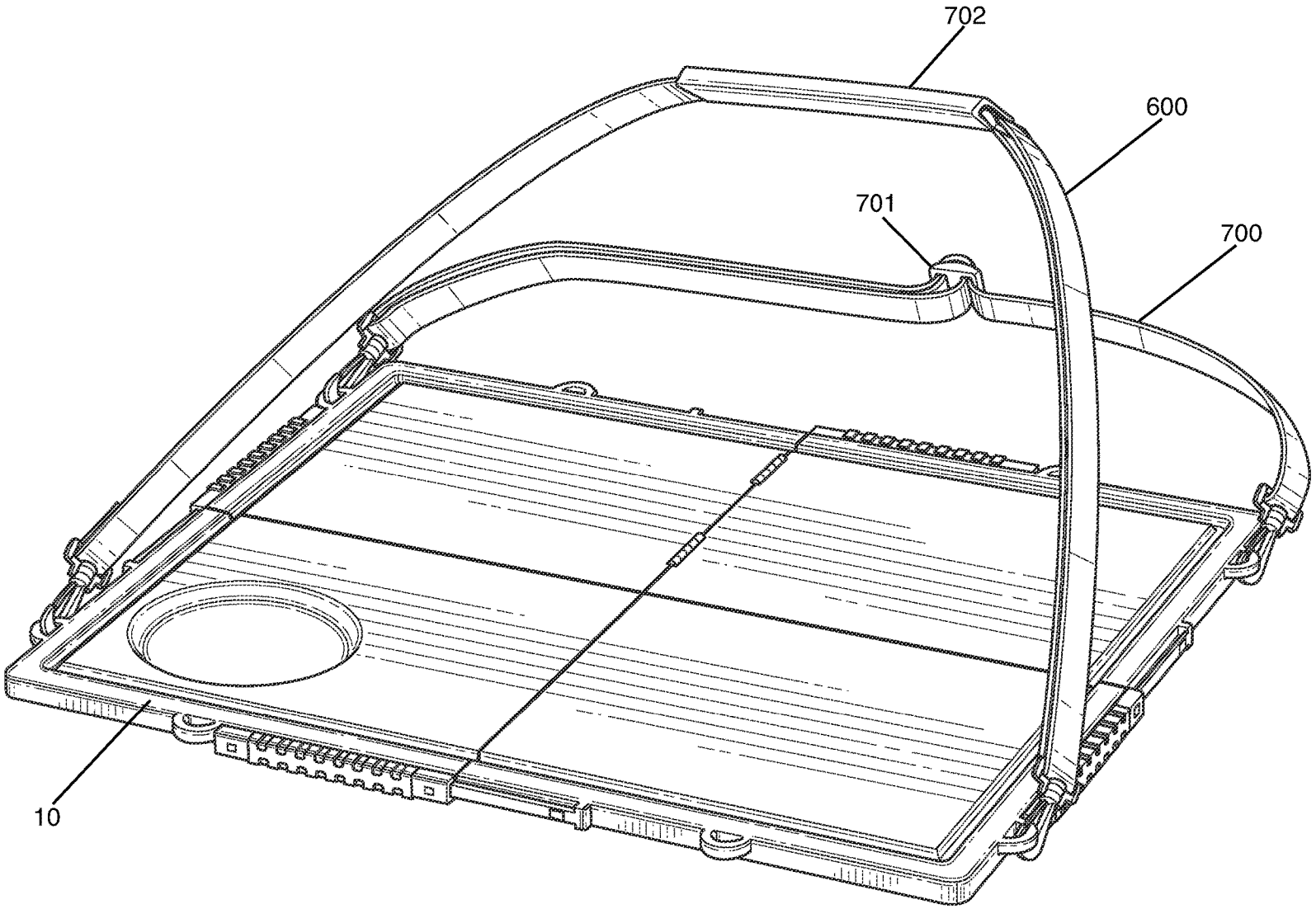
FIG. 10 is an isometric view of one embodiment of the present invention including a waist and neck strap such that the table can be worn around a person's neck or waist.

In addition, the portable folding table 10 includes strap attachment points 500 for straps 600 and 700, as shown in FIGS. 8 and 9.

While FIGS. 1-10 show an embodiment with four panels, other embodiments can include two panels for a table that folds in half, three panels for a circular table embodiment that folds into thirds or four or more panels.

In these and other embodiments, the panels 11*a-d* may include a channel 12 for preventing liquids from spilling off the table surface.

Figure 5:
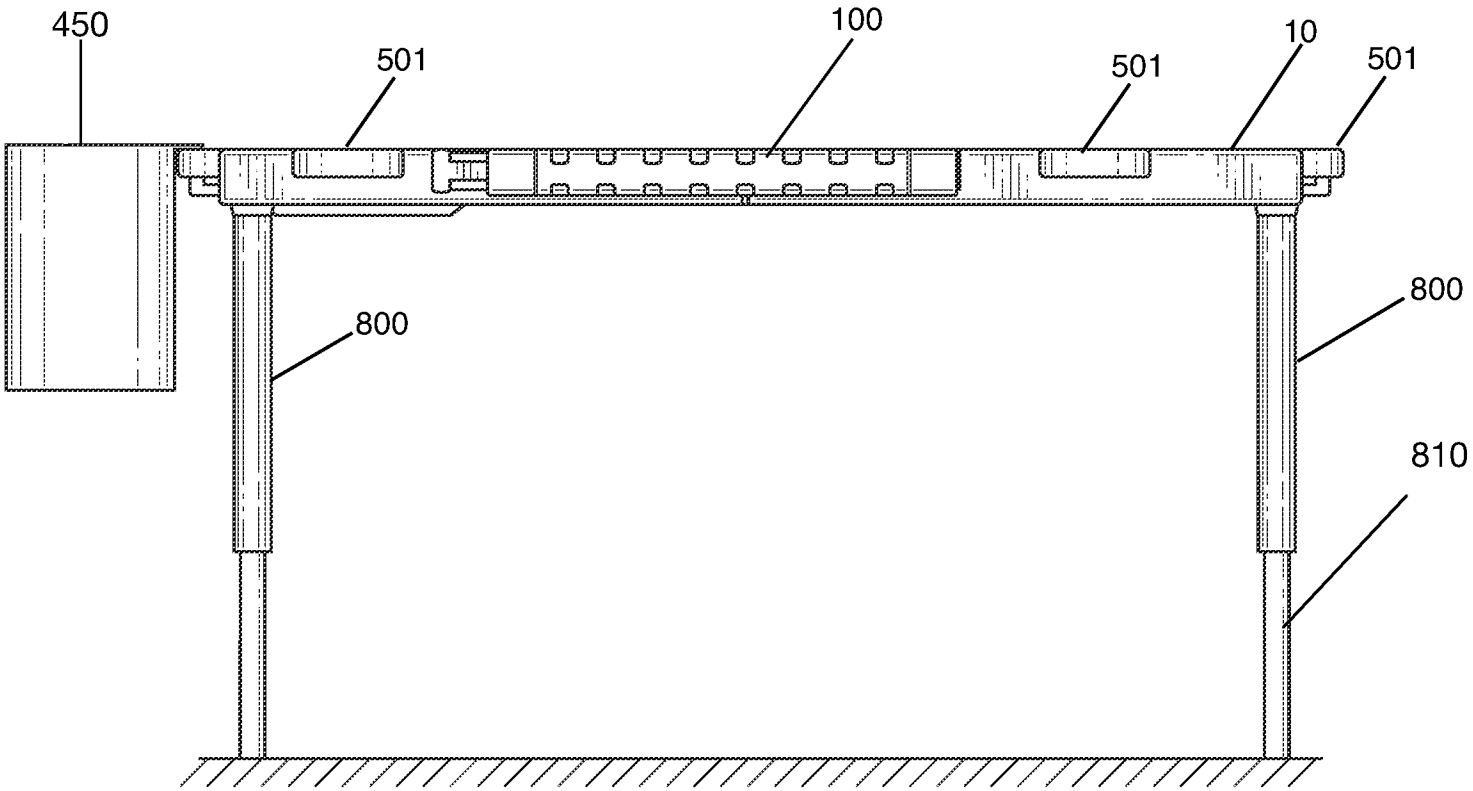
FIG. 5 is a side view of one embodiment of the present invention including detachable legs and a cup holder.

In one embodiment, shown in FIG. 5, the portable folding table 10 includes a telescoping leg or legs 800 that extend outwardly from a bottom face of the portable folding table 10 and may be attached to the portable folding table 10 using attachment points 801. In this and other embodiments, the telescoping legs 800 can be folded into the table when unused or deployed to a desired length to stand on a surface and level the portable folding table 10 as needed.

In one embodiment, legs are not telescoping but rather are of a fixed length and can be either threaded in to the panels and attachment points or snapped in for attachment of the legs to the table.

In this and other alternative embodiments, the portable folding table 10 can also include a mechanism to attach a cup holder 400 with an adapter such that a user can adjust a size of the cup holder to fit various cup sizes. The cup holder adapter can also cover the entire opening of the cup holder such that it looks flush with the rest of the table and food or other objects do not fall through those openings. In yet another embodiment, the portable folding table 10 includes at least one recessed indentation 401 in the corner of at least one panel instead of an opening for a cup holder. In this particular embodiment, instead of a snap in cup holder 400, the portable folding table 10 comprises indentations and deep depressions of various sizes 401.

In one embodiment, the recessed indentation 400 is a 0.5 inch to 1 inch deep depression in at least one panel capable of accepting a cup, bottle, can, or other beverage or liquid container. The recessed indentation 400 can also be used for sauces, dips, bowls, or other containers.

In some embodiments, the opening for a cup holder attachment 400 includes an adapter such that a user can adjust a size of the opening to fit various cup sizes 401. Here, the cup holder attachment can be located at the same position as the recessed indentation 400. In some embodiments, the recessed indentation can be removed from the table and a cup holder attachment can take its place. In other embodiments, that same indentation or cup holder can be replaced by a flush cover making the entire table top a flat surface. In some embodiments, the recessed indentation, cup holder and flush attachments are interchangeable and can either be snapped into the modular location 400, screwed into place, or attached thanks to magnets.

In another embodiment, the portable folding table 10 also includes openings or attachments along the outer perimeter 105 of the portable folding table adapted for trash receptacles 450. These can be hooks or openings where a user can attach a receptacle that can hang from the surface of the table and adapted to receive waste. In some embodiments, these adapted trash receptacles can be bins that pop in or out of the table when in use, and removable to remove the trash then can be placed back onto the foldable table. The trash receptable can also be made of reusable and/or recyclable materials.

The portable folding table 10 can be worn around a person's neck or waist thanks to one or more straps 600 and 700 that attach to the folding table and can be worn on a person. While worn, the straps 600 and 700 and strap attachments 501 make it such that the portable folding table 10 stays horizontally flat when worn so that food or liquid do not spill from the portable folding table 10. The neck strap 600 is worn around the neck and may be used with or without the waist strap 700. The straps 600 and 700 can be made out of hemp, fabric or any other suitable material for worn straps.

In addition, in this and other embodiments, the straps 600 and 700 may include length adjustment devices 701 and padding 702 for user comfort.

The present invention is also embodied in a method of folding a two or more axis folding table into a quarter-sized self-contained carrying case including the steps of obtaining a table top including two or more panels together forming a table top when extended into a flat position, including a first panel and a second panel being hinged with a slide locking hinge 100 along the outer edges of where the panels meet.

In some embodiments, the portable folding table further includes a rechargeable battery adapted to be solar powered or recharged by an external battery source. In other embodiments, the portable folding table can also comprise a power outlet such a user can recharge his or her devices by connecting them to the power outlet of the portable foldable table. In one embodiment in particular, the power outlet can be removed and reinstalled by a user. In other embodiments, a module placed on the table can be used as a rechargeable battery and power outlet allowing a user to recharge their devices.

In some embodiments, the charging station attached to the external loops 501 and can be placed on an outer section of the table similarly positioned to where the trash receptable 450 is located. In other embodiments, the portable folding table does not have loops for external attachments, but instead, has a charging station that snaps onto the outer perimeter of the table.

In another embodiment not depicted here, the portable folding table also includes a floatable attachment adapted to fit around the portable folding table panels making the portable folding table buoyant when used in a body of water. In another embodiment, the floatable attachment includes a separate contiguous section adapted to hold a user's drink wherein the entire portable folding table and external cup attachment are floatable. Here, the floatable element is to be secured on the outer perimeter of the panels when open, and can further include additional floatable attachment for a user to add their own personal accessories to the floating table. In one embodiment, the portable folding table comes with an additional cover that goes around the outer perimeter of the table where the cover is buoyant and helps the table stay afloat on a body of water. In other embodiments, the cover is to be placed around the perimeter of the open table and underneath a bottom surface of the table to keep the table buoyant and afloat.

In one particular embodiment, the present disclosure is a portable folding table comprising four panels operable to form a tabletop when extended into a flat position, where each panel has an outer side and an inner side, a hinge, where two panels are hinged together by the hinge along the outer sides of the panels. Here a first panel is configured to fold onto a second panel about a first axis defined by the outer edges of the first and second panel and a fourth panel is configured to fold onto a third panel about a second defined by the outer edges of the third and fourth panel, wherein the four panels are operable to fold the tabletop into a portable carrying device.

In another embodiment, the hinge is a sliding hinge 100 which also includes a stopping mechanism adapted to keep the portable folding table in a desired folded position or flat position. In some embodiments, the stopping mechanism terminates in an angled protrusion 102 for proper locking of the portable folding table in a desired folded or flat position. In one particular embodiment, the sliding hinge 100 travels along a rail 101. The rail 101 terminates on a first end in an angled protruding tab 102 for a folded position of the portable folding table and terminates in a flat second opposite end opposite the first end on the rail 101 for a flat position of the portable folding table. The rail 101 and sliding hinge 100 are located on an outer perimeter 105 of each of the panels (11*a*, 11*b*, 11*c*, and 11*d*).

In one particular embodiment, the sliding hinge 100 is not locked in an open or closed position, but rather, remains in an open or closed position thanks to a resistance between the sliding hinge 100 and the rail 101 along which it travels. In other embodiments, the angled protrusion and tab 102 affords additional resistance to keep the sliding hinge in a desired position. In one particular embodiment, when the table is in a folded or open position, it remains in place thanks to snap-fits. In other embodiment, the sliding hinge slide 100 just slides and stops at the first open position or second closed position. In one embodiment the sliding hinge 100 further includes a groove to ensure the sliding about the rail 101 and does not go over either one of the ends thanks to a resistance between the sliding hinge 100 and the rail 101 at a first end and at the second end of the rail.

In another embodiment, the portable folding table has each sliding hinges slide along a rail 102 terminating in an angled protruding tab on a first end and on a second end of the rail 102. The angled protrusion and tab ensures that the hinges remain in the desired positions. In another embodiment, the sliding hinge terminated in a tab on one end and in an external loop attachment on an opposite second end of the rail 102. Here all sliding hinges are located on an outer perimeter of each of the panels 105.

In one embodiment, the portable folding table system has four quarter panels such that the portable folding table is operable to fold along a plurality of edges of the panels, wherein when folded, the portable folding table is as small as a surface area of one panel.

As shown in FIGS. 4, 5, 8 and 9 when the table is in an open position, the sliding hinges 100 is cover the gaps between the panels to ensure that the table remains in a flat position. As shown here, the rail 102 terminates on one end over the gap between the panels such that the end of the rail and the sliding hinge is covering the gaps to ensure that the table is secured in a flat and usable position. In other embodiments when the table is just opened or unfolded, the sliding hinge does not cover the gap but can be slid to the other end of the rail to cover the gap and secure the sliding hinge in a locked position for the table. In some embodiments, the locked position can be to the right end of the rail while in other embodiments, the locked position can be to the left.

In another embodiment, the portable folding table system includes either a plurality of telescoping legs 810 and/or a plurality of fixed legs 800 extending outwardly from a bottom face of the portable folding table which attaches to the portable folding table by means of an attachment point. These pluralities of legs can either snap into the bottom of the table, or can be threaded into the bottom of the table into attachment points for the legs.

In one particular embodiment, the overall size of the portable folding table is 16 in wide by 12 in deep. The portable folding table folds into a 8 in wide by 6 in deep size and when folded its 1½" thick.

In one embodiment, a user can attach the table around the user's neck thanks to the neck straps and use their legs in a sitting position to help keep the table in a flat position when sitting down. In other embodiments, the user can attach the table to their neck and/or waist while sitting down while in other embodiments, the user can just lay the table flat over their lap/legs while seated. Both neck and waist strap are adjustable to allow a personalized fit for the user. Additional padding can be placed on the neck and waist strap or removed at a user's discretion.

In one embodiment, the portable folding table system and the portable folding table can made out of one of a group consisting of plastic, wood, metal, can include a non-slip material, or have a non-slip material and antibacterial cover to go over each panel. In some embodiments, the neck and waist strap can be made out of hemp, nylon, or any organic reusable and washable material. In other embodiments, the portable table system can also include a channel insert from the outer perimeter of the at least two panels 12.

In one embodiment, the present disclosure is embodied as a method of folding and deploying a portable folding table comprising the steps of moving a sliding hinge away from a protruding tab on each of a plurality of panels of the portable folding table; unfolding each of said plurality of panels to lay the portable folding table in a flat position; and moving said sliding hinge along a rail opposite said protruding tab to keep the portable folding table in a flat position.

In other embodiments, the method also includes attaching at least one of a telescoping leg or a flat leg to a bottom attachment point of each of the plurality of panels such that the portable folding table rests on one or more legs; and securing at least one of a neck strap or a waist strap on a user allowing for the portable folding table to be worn and secured flat on a body of a user.

In yet another embodiment, the method also includes the steps of moving the sliding hinge onto the protruding tab on each of a plurality of panels of the portable folding table; folding each of said plurality of panels to fold the portable folding table in a folded position wherein said portable folding table folds to a surface as small as a surface area of one panel; and moving said sliding hinge along a rail opposite onto the protruding tab to keep the portable folding table in a folded position.

As mentioned above, other embodiments and configurations may be devised without departing from the spirit of the invention and the scope of the appended claims.

The invention claimed is:

1. A portable folding table comprising:

at least two panels defining an outer perimeter of the portable folding table, wherein the at least two panels are operable to move between a flat position and a folded position;

a first side along a first panel;

a second side opposite said first side along a second panel;

a first sliding hinge alongside said first side and said perimeter operable to slide and lock the at least two panels together in the flat position;

a second sliding hinge alongside said second side and said perimeter operable to slide and lock the at least two panels together in a flat position; wherein said first sliding hinge and said second sliding hinge slide along a first rail and a second rail, respectively, wherein both said first rail and said second rail have a first end and a second end, wherein said sliding hinges slide along said rails from said first end toward said second end, and said rails terminate in an angled protruding tab at said second end, wherein said angled protruding tab is operable to prevent said sliding hinges from sliding further along said rails, and wherein when said sliding hinges are slid to or past said first end, then said at least two panels may be set into a folded position and when said first sliding hinge is moved to said second end against said angled protruding tab said at least two panels are locked in a flat position.

2. The portable folding table of claim 1 further comprising four quarter panels such that the portable folding table is operable to fold along a plurality of edges of the panels, wherein when folded, the portable folding table is as small as a surface area of one panel.

3. The portable folding table of claim 1 further comprising at least one of a telescoping leg or a fixed leg extending outwardly from a bottom face of the portable folding table which attaches to the portable folding table by means of an attachment point.

4. The portable folding table of claim 1 further comprising at least one of an opening for a cup holder attachment with an adapter having an adjustable size of the opening to fit various cup sizes; and a recessed indentation in at least one panel of the portable folding table, wherein the recessed indentation is operable to locate a container.

5. The portable folding table of claim 1 further comprising openings along the outer perimeter of the portable folding table adapted for trash receptacles.

6. The portable folding table of claim 1 further comprising a neck strap such that a user can support the portable folding table around a neck of the user.

7. The portable folding table of claim 1 further comprising supporting means such that the table stays horizontally balanced when supporting a food or an electronic and supported by a neck of a user.

8. The portable folding table of claim 1 further comprising a waist strap operable to allow a user to wear the portable folding table around a waist of the user.

9. The portable folding table of claim 1 further comprising supporting means such that the table stays horizontally balanced when supporting food and worn around a user's waist.

10. The portable folding table of claim 1 further comprising at least one attachment mechanism attached to said table operable to hold at least one eating utensil.

11. A portable folding table system comprising:

four panels operable to form a tabletop when extended into a flat position, wherein each panel has an outer side and an inner side;

a hinge, wherein two panels are hinged together by the hinge along the outer sides of the panels;

a first panel is configured to fold onto a second panel about a first axis defined by one or more outer edges of the first and second panel; and a fourth panel is configured to fold onto a third panel about a second axis defined by the outer edges of the third and fourth panel, wherein said second axis is perpendicular to said first axis, wherein the four panels are operable to fold the tabletop into a portable carrying device.

12. The portable folding table system of claim 11 wherein said hinge is a sliding hinge further comprising a stopping mechanism adapted to keep said portable folding table in a desired folded position or flat position.

13. The portable folding table system of claim 12 wherein said stopping mechanism terminates in an angled protrusion for proper locking of the portable folding table in a desired folded or flat position.

14. A method of folding and deploying a portable folding table comprising the steps of:

a. moving a sliding hinge along a rail and away from a protruding tab at one end of said rail, on each of a plurality of panels of the portable folding table, wherein said rail extends onto at least two of said plurality of panels when said plurality of panels is in a flat position;

b. unfolding each of said plurality of panels to lay the portable folding table in a flat position; and c. moving said sliding hinge along said rail, so that said sliding hinge engages said rail on both of said at least two of said plurality of panels and thereby locks said plurality of panels in a flat position.

15. The method of folding and deploying a portable folding table of claim 14 further comprising the steps of:

a. attaching at least one of a telescoping leg or a flat leg to a bottom attachment point of each of the plurality of panels such that the portable folding table rests on one or more legs; and b. securing at least one of a neck strap or a waist strap on a user allowing for the portable folding table to be worn and secured flat on a body of a user.

16. The method of folding and deploying a portable folding table system of claim 14 further comprising the steps of:

a. moving the sliding hinge onto the protruding tab on each of a plurality of panels of the portable folding table;

b. folding each of said plurality of panels to fold the portable folding table in a folded position wherein said portable folding table folds to a surface as small as a surface area of one panel; and moving said sliding hinge along a rail opposite onto the protruding tab to keep the portable folding table in a folded position.

* * * * *